US009743789B2

(12) United States Patent
Boutsikaris

(10) Patent No.: US 9,743,789 B2
(45) Date of Patent: Aug. 29, 2017

(54) PORTABLE TABLE MOUNTING STORAGE BASKET APPARATUS

(71) Applicant: Scott Peter Boutsikaris, Scotch Plains, NJ (US)

(72) Inventor: Scott Peter Boutsikaris, Scotch Plains, NJ (US)

(73) Assignee: Scott P. Boutsikaris

( * ) Notice: Subject to any disclaimer, the term of this patent is extended or adjusted under 35 U.S.C. 154(b) by 0 days.

(21) Appl. No.: 14/720,758

(22) Filed: May 23, 2015

(65) Prior Publication Data

US 2016/0338520 A1 Nov. 24, 2016

(51) Int. Cl.
*A47G 29/093* (2006.01)
*B65D 25/22* (2006.01)

(52) U.S. Cl.
CPC ..... *A47G 29/093* (2013.01); *B65D 25/22* (2013.01)

(58) Field of Classification Search
CPC ..... A47G 29/093; B65D 25/22
USPC ..... 211/119.003, 119.005, 119.007; 108/26, 108/28, 50.11; 220/751; D6/513, 673, D6/684; D7/552.1
See application file for complete search history.

(56) References Cited

U.S. PATENT DOCUMENTS 581,681 A * 4/1897 Shauer ..... A47B 17/036 108/26
934,676 A * 9/1909 Langslow ..... A47B 17/036 211/119.005
1,089,845 A * 3/1914 Long ..... B43K 23/002 108/26
1,979,773 A * 11/1934 Ritch ..... B43K 23/001 144/286.1
2,090,176 A * 8/1937 Besancon ..... A47B 1/04 108/92
2,169,183 A * 8/1939 Fish ..... A47G 29/093 211/86.01
2,831,598 A * 4/1958 Slavsky ..... B65D 25/22 211/88.01
2,972,417 A * 2/1961 Smith ..... A47F 9/00 108/152
3,187,924 A * 6/1965 Marcus ..... A47F 5/0823 220/480
3,239,272 A * 3/1966 Wilkins ..... A47C 7/68 211/119.007

(Continued)

*Primary Examiner* — Michael Safavi

(57) ABSTRACT

A portable table mounting storage basket apparatus that is quickly attachable and detachable by way of two small "L"-shaped brackets at the top of the backside, and a large removable "U"-shaped bracket centered at the backside with a "T"-shaped formation at the top of the end of the "U" that is not making contact and is protruding from the back of the basket. The two small "L"-shaped brackets at the top are to attach the apparatus to the top of a table, while the large removable "U"-shaped bracket with "T" formation is to be placed under a table to hold the apparatus in place when weight is placed into the basket. The "U"-shaped bracket with "T" formation is removable so as to allow the invention to fit onto a table with a larger edge. The large "U"-shaped bracket extends significantly further from the basket than the small "L"-shaped brackets to provide stability while making contact with the bottom surface of a table, especially when supporting significant weight in the basket.

1 Claim, 4 Drawing Sheets

(56) References Cited

U.S. PATENT DOCUMENTS

| | | | | | |
|---|---|---|---|---|---|
| 3,907,104 | A * | 9/1975 | Taub | B65D 5/6658 | 206/45.23 |
| D237,672 | S * | 11/1975 | Taub | D6/513 | |
| 3,949,880 | A * | 4/1976 | Fortunato | A47F 5/0068 | 211/119.003 |
| 4,831,673 | A * | 5/1989 | Winckler | A47C 21/00 | 248/241 |
| D355,552 | S * | 2/1995 | Whited | D6/513 | |
| 6,557,711 | B2 * | 5/2003 | Grueneberg | A47F 5/0068 | 211/119.003 |

* cited by examiner

PORTABLE TABLE MOUNTING STORAGE BASKET APPARATUS

BACKGROUND OF THE INVENTION

1. Field of the Invention

The present invention relates to a portable and mountable storage basket apparatus, and more particularly a portable and mountable storage basket apparatus for a table or workbench that can be easily attached or removed and can support significant weight.

The portable table mounting storage basket apparatus has two small "L"-shaped brackets extended outward from the top back of the basket to rest on the top surface of a table, and a "T"-shaped formation extended upward from one end of a large "U"-shaped bracket attached to the bottom center of the backside of the basket which makes contact with the bottom surface of a table and is removable to allow the invention to be attached to a table with a larger edge.

2. Description of Related Art

Currently, storage baskets exist that are attachable to tables, workbenches, etc. by way of bolts or screws and the like. This makes more room on the top surface of a table or workbench for space to be used, but the basket is not quickly removable, and there are limitations as to what type of table or workbench it can be attached to, (i.e.—thin topped tables, glass tables, etc.) not to mention the damage caused by bolts or screws.

Easily removable storage baskets that are mountable are produced, but most are limited to being affixed to a pegboard, shelving system, or something of the like. Easily removable mountable storage baskets that use suction cups for mounting purposes can hold no significant weight.

The present invention allows extra space to be made on the top surface of a table or workbench by storing objects in the basket, but is also quickly attachable and removable, without damaging the surface of the table or workbench, can support significant weight, and can either be quickly placed on another table or workbench, or just taken off and placed out of the way if not needed.

SUMMARY OF THE INVENTION

The primary objective of the present invention is to make more available space on the top surface of a table or workbench by storing objects in an easily attachable, but easily removable basket apparatus that is capable of supporting significant weight while being affixed to a table or workbench without damaging the afore mentioned objects.

DETAILED DESCRIPTION OF THE PREFERRED EMBODIMENT

Figure 1:
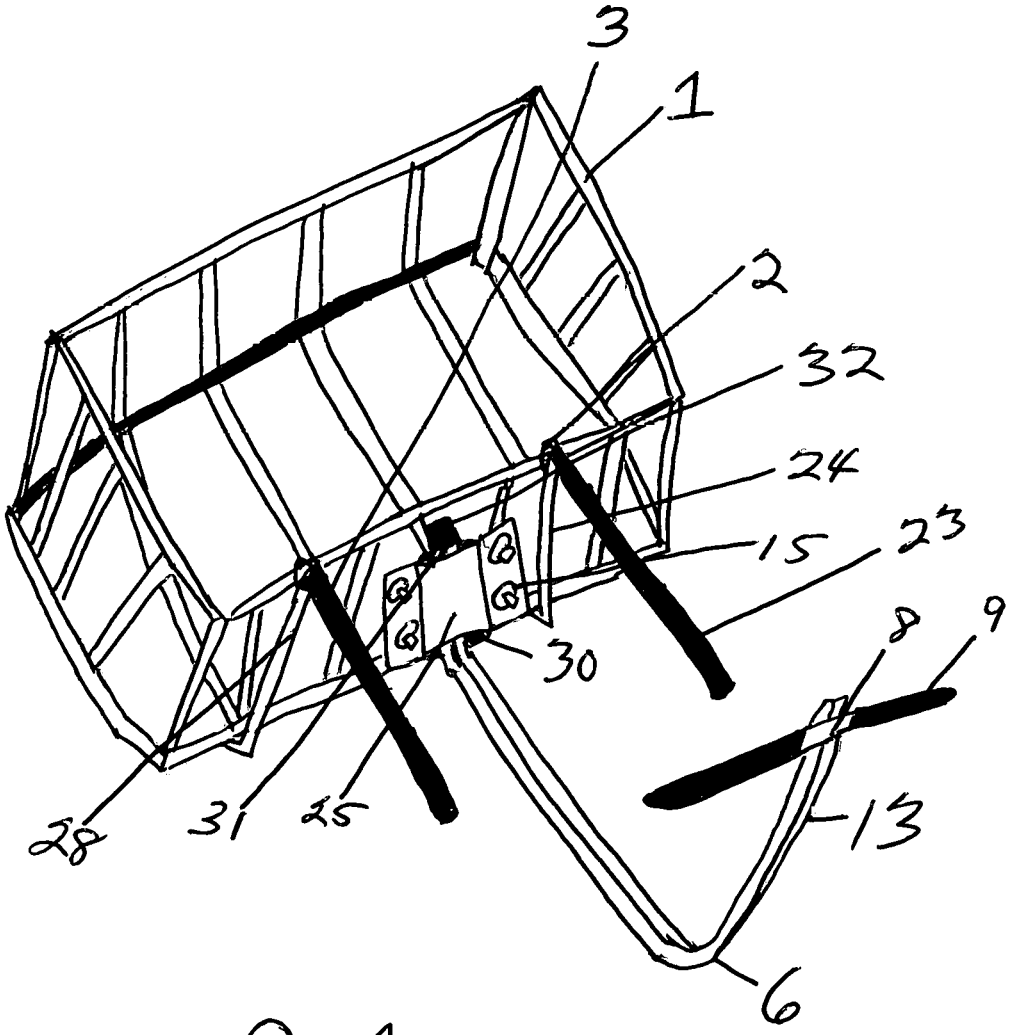
FIG. 1 is a perspective view illustrating the embodiment of the portable table mounting storage basket apparatus.

With reference to FIG. 1, the portable table mounting storage basket apparatus in accordance with the present invention comprises a basket (1), two small "L"-shaped brackets (2), and a large "U"-shaped bracket (6) with flat piping (8) attached to the top of one end to produce a "T" formation.

The two small "L"-shaped brackets (2) include one rubber covering (3) for each bracket. The two small "L"-shaped brackets (2) each have a top horizontal arm (23), which is extended outward from the rear side (28) top of the basket (1) and a vertical arm (24) which is connected to the outside rear (28) of the basket (1) by way of welding. The rubber coverings (3) are placed over the horizontal arms (23) of the small "L"-shaped brackets (2).

Figure 2:
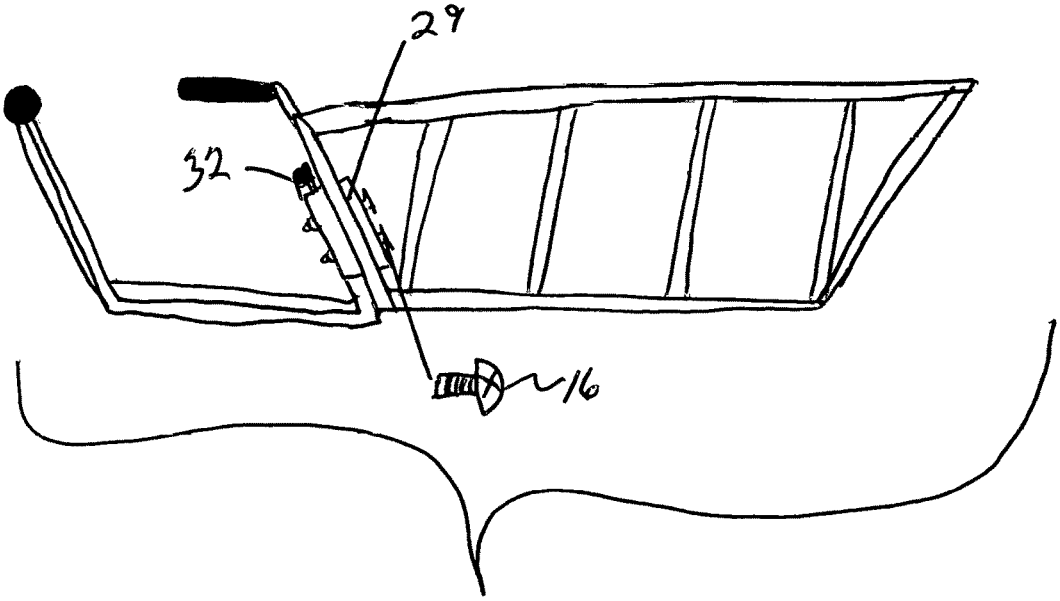
FIG. 2 is a side view of the portable table mounting storage basket apparatus shown in FIG. 1.
Figure 4:
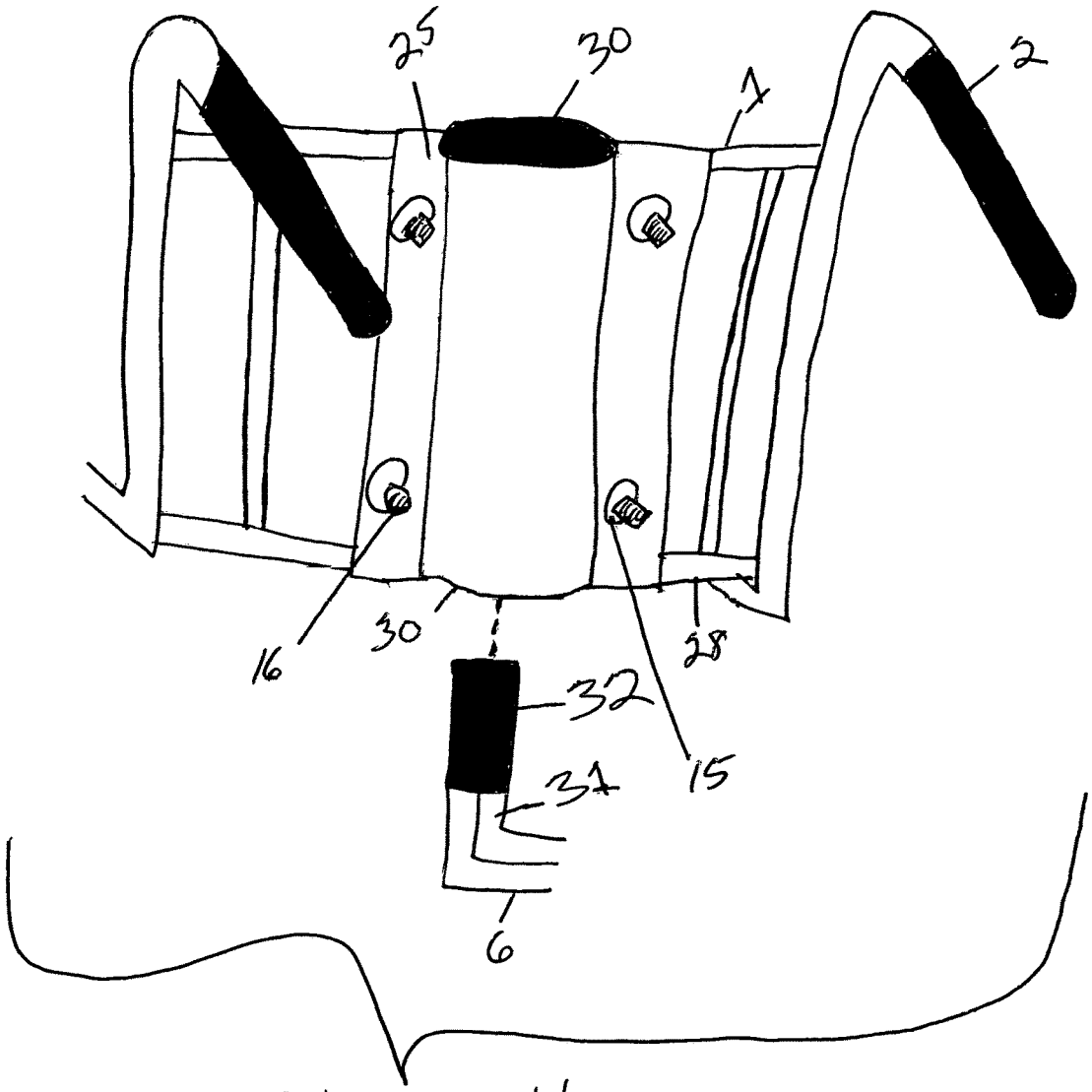
FIG. 4 is an exploded partial perspective view of the portable table mounting storage basket apparatus shown in FIG. 1 with both major components separated.

With reference to FIGS. 1, 2, and 4, the large "U"-shaped bracket (6) with flat piping (8) at the top of the long arm (13) includes two plates (25) (29), four bolts (16), and four nuts (15) to connect the large "U"-shaped bracket (6) to the backside (28) of the basket (1), a rubber cover (32) for the short arm (31), and rubber covers (9) for both sides of the "T" formation.

The four bolts (16) are placed through holes (not numbered) in the plate (29) on the inside of the backside (28) of the basket (1), and then through holes (not numbered) in the plate (25) on the outside of the backside (28) of the basket (1) and held in place by nuts (15) to keep the plates (25) (29) attached to the backside (28) of the basket (1).

The large "U"-shaped bracket's (6) shorter vertical arm (31) has a rubber covering at the end (32) to prevent slipping and is attached to the outside of the bottom center of the rear side (28) of the basket (1) by placing it through a slot (30) on the plate (25) on the outside of the backside (28) of the basket (1).

The large "U"-shaped bracket finally has a longer vertical arm (13) which is extended upward and welded to a horizontal piping (8) with a rubber covering on both sides (9) to form a "T" thus completing the assembly of the present invention.

Figure 3:
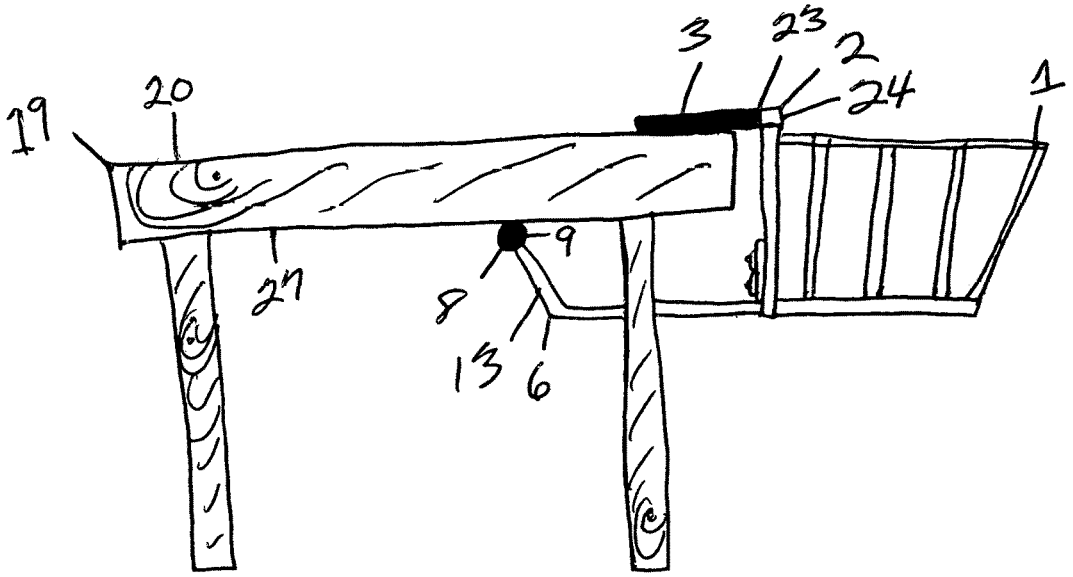
FIG. 3 is a side view of the portable table mounting storage basket apparatus shown in FIG. 1 mounted on a table.

With reference to FIG. 3, the invention is resting on the top surface (20) of a table (19) by way of the two horizontal arms (23) of the two small "L"-shaped brackets (2), and held in place on the bottom surface (27) of the table (19) by the horizontal piping (8) which is attached to the longer vertical arm (13) of the large "U"-shaped bracket (6) to make a "T"-shaped formation.

The invention is also designed as such that when weight is placed into the basket (1), the grip becomes tighter on the table (19) by way of the horizontal piping (8) of the "T"-formation being forced against the bottom surface (27) of the table (19) with the two small "L"-shaped brackets'(2) horizontal arms (23) holding the apparatus in place.

With reference to FIGS. 1 and 4, the "T"-formation (comprised primarily of the horizontal piping (8) and the longer vertical arm (13) of the large "U"-shaped bracket (6)) can be removed by way of taking the shorter vertical arm (31) of the large "U"-shaped bracket (6) out of the slot (30) at the bottom of the outside plate (25) attached to the backside (28) of the basket (1) to allow the invention to fit onto a table with a larger edge.

It should be understood that while numerous characteristics and advantages of the present invention have been set forth by way of the previous description, together with details of the structure and function of the invention, the disclosure is illustrative only, especially in matters of shape, size, and arrangement of components within the principles of the invention to the full extent indicated by the broad general meaning of terms in which the appended details and claims are expressed, and may vary from said details if only to improve efficiency of structure, simplicity of design, cost, etc.

What is claimed is:

1. A portable table mounting storage basket apparatus comprising a basket, two small "L"-shaped brackets each comprising an arm extending outwardly from the basket with rubber coverings on the extended arms of each "L"-shaped bracket, a large "U"-shaped bracket comprising a first upstanding leg and a second upstanding leg, the second upstanding leg having a cross member providing a "T" formation at the top thereof, the "U"-shaped bracket having a rubber covering on one end of the first upstanding leg and a rubber covering on both ends of the cross member of the "T" formation, a first mounting plate along an outside of the basket, a second opposing mounting plate along an inside of the basket, four nuts, and four bolts securing the first and second mounting plates to one another.

* * * * *